US009140025B2

(12) United States Patent
Barcroft

(10) Patent No.: US 9,140,025 B2
(45) Date of Patent: Sep. 22, 2015

(54) LONG TRAVEL LIFT SYSTEM

(71) Applicant: Victor N. Barcroft, North Barrington, IL (US)

(72) Inventor: Victor N. Barcroft, North Barrington, IL (US)

( * ) Notice: Subject to any disclaimer, the term of this patent is extended or adjusted under 35 U.S.C. 154(b) by 0 days.

(21) Appl. No.: 14/214,217

(22) Filed: Mar. 14, 2014

(65) Prior Publication Data

US 2014/0260070 A1 Sep. 18, 2014

Related U.S. Application Data

(60) Provisional application No. 61/781,470, filed on Mar. 14, 2013.

(51) Int. Cl.

| | |
|---|---|
| ***B66F 3/10*** | (2006.01) |
| ***E04G 23/02*** | (2006.01) |
| *E04B 1/35* | (2006.01) |

(52) U.S. Cl.

CPC ..... *E04G 23/0266* (2013.01); *E04B 1/3527* (2013.01)

(58) Field of Classification Search

USPC ..... 254/93 R, 93 H, 89 R, 93 L, 1; 414/10; 52/126.6

See application file for complete search history.

(56) References Cited

U.S. PATENT DOCUMENTS

| | | | | |
|---|---|---|---|---|
| 1,231,462 | A | | 6/1917 | Tutwiler |
| 1,685,144 | A | | 9/1928 | Austin |
| 2,222,243 | A | | 11/1940 | Sandstrom |
| 2,671,638 | A | | 3/1954 | Allen |
| 2,675,211 | A | | 4/1954 | Regoord |
| 2,732,177 | A | | 1/1956 | Ludowici |
| 2,777,660 | A | | 1/1957 | Albrecht |
| 2,896,908 | A | | 7/1959 | Stone |
| 3,206,090 | A | | 3/1962 | Anderson |
| 3,158,354 | A | | 11/1964 | Ward |
| 3,222,030 | A | | 12/1965 | Thorpe |
| 3,337,187 | A | | 8/1967 | Sumner |
| 3,655,161 | A | | 4/1972 | Schueler |
| 3,861,647 | A | | 1/1975 | Meredith |
| 3,870,268 | A | | 3/1975 | Larkin |
| 3,891,184 | A | * | 6/1975 | Fields ..... 254/4 R |
| 4,229,919 | A | * | 10/1980 | Hughes ..... 52/263 |
| 4,508,316 | A | | 4/1985 | Millard |
| 4,647,014 | A | | 3/1987 | Ekman |
| 4,757,975 | A | | 7/1988 | Gordon et al. |
| 4,930,270 | A | * | 6/1990 | Bevacqua ..... 52/126.1 |
| 5,232,204 | A | | 8/1993 | Nunez |
| 5,528,948 | A | | 6/1996 | De Gelis |

(Continued)

*Primary Examiner* — Lee D Wilson
*Assistant Examiner* — Nirvana Deonauth
(74) *Attorney, Agent, or Firm* — Meroni & Meroni, P.C.; Charles F. Meroni, Jr.

(57) ABSTRACT

A long travel lift system, apparatus, and method enables users to raise a structural cap from a structural bottom for creating a fillable space between the structural cap and structural bottom for receiving a second, cap-supporting construction intermediate the structural cap and structural bottom. The long travel lift system incorporates a series lift apparatuses, each of which include a telescopic tube construction and winch assembly for imparting a lift force to an inner tube of the telescopic tube construction for extending the inner tube relative to an outer tube. The load lifting force is transmitted to the inner tube from the winch assembly via a pulley assembly and lengthwise slot formed in the outer tube of the tube construction. The outer tube is reinforced with various structures in view of the slot formation. The winch assembly is outfitted with a transmission for enhancing rotational speed of the winch assembly.

30 Claims, 9 Drawing Sheets

(56) References Cited

U.S. PATENT DOCUMENTS

| | | | | |
|---|---|---|---|---|
| 5,617,698 | A * | 4/1997 | Guilmette | 52/749.1 |
| 5,819,482 | A * | 10/1998 | Belke et al. | 52/126.6 |
| 6,234,440 | B1 * | 5/2001 | Boney et al. | 248/354.1 |
| 6,942,198 | B2 * | 9/2005 | Huang | 254/387 |
| 7,195,216 | B2 * | 3/2007 | Wang | 248/157 |
| 7,857,287 | B2 | 12/2010 | Rucks | |
| 8,033,527 | B2 | 10/2011 | Pasto | |
| 8,356,797 | B1 * | 1/2013 | Searer et al. | 254/100 |
| 2003/0039531 | A1 * | 2/2003 | Bickle | 414/11 |
| 2007/0221900 | A1 * | 9/2007 | Giralde | 254/418 |
| 2009/0283653 | A1 * | 11/2009 | Zhang | 248/352 |
| 2011/0097180 | A1 * | 4/2011 | Bastone | 414/10 |

* cited by examiner

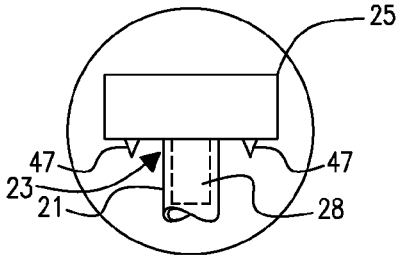
Fig. 9C
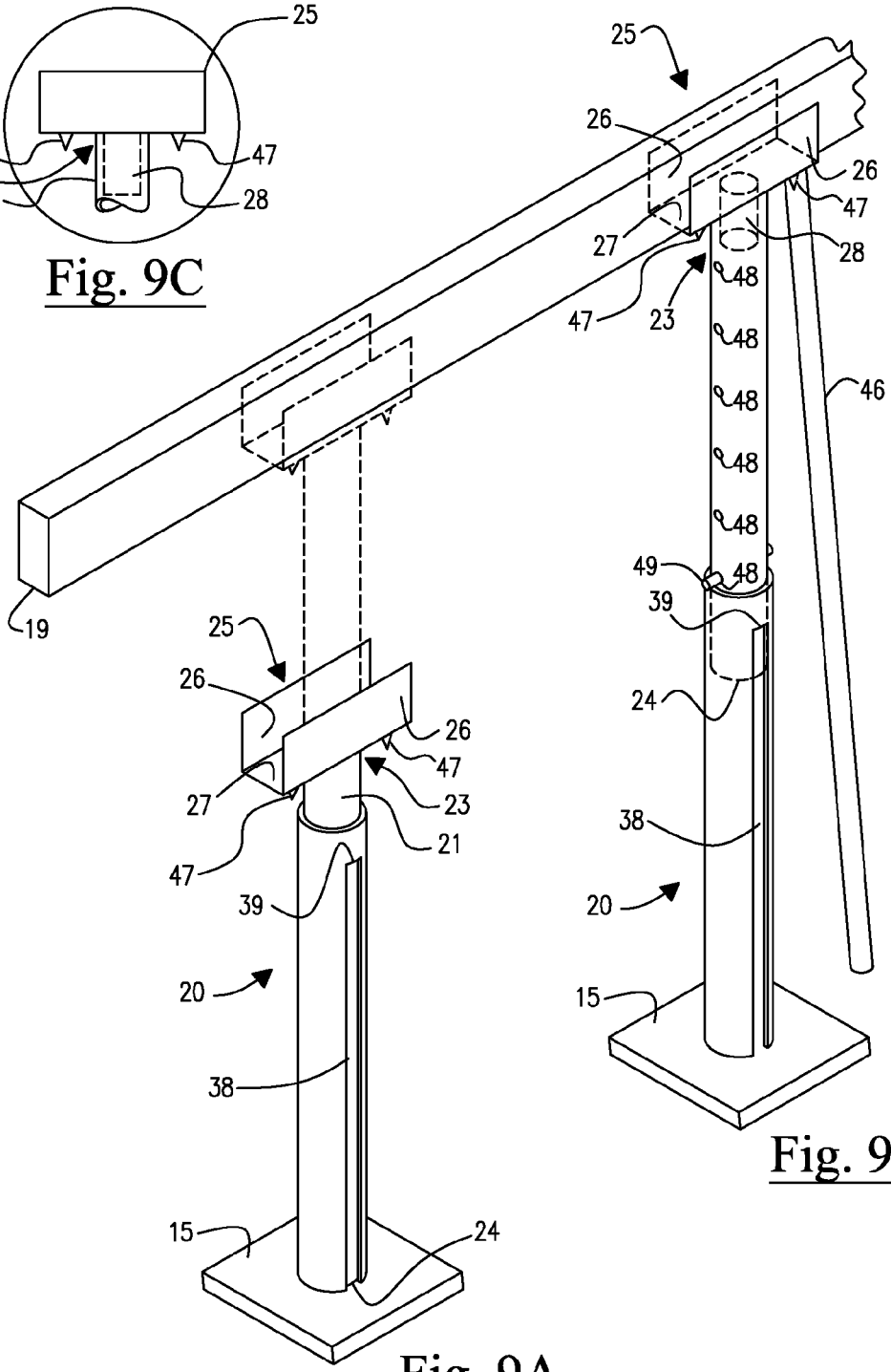
Fig. 9B
Fig. 9A

LONG TRAVEL LIFT SYSTEM

PRIOR HISTORY

This non-provisional patent application claims the benefit of U.S. Provisional Patent Application No. 61/781,470 filed in the United States Patent and Trademark Office on 14 Mar. 2013.

BACKGROUND OF THE INVENTION

1. Field of the Invention

The present invention relates generally to a lift apparatus for lifting a load from a first position to a second position. More particularly, the present invention relates to a lift apparatus for lifting a structural load as exemplified by a structural cap or roof construction from a first supported position atop a structural bottom to a second raised position for creating a fillable space between the raised second position and the structural bottom, which fillable space may then be filled a second, cap-supporting construction.

2. Brief Description of the Prior Art

Certain prior art generally related to the subject invention are briefly described hereinafter. U.S. Pat. No. 1,685,144 ('144 patent), which issued to Austin for example, discloses an Elevator and Support for Wall Boards and the Like. The '144 patent describes a device for elevating wall boards and the like to ceilings and supporting them in the place to be nailed. The device comprises, in combination, a base, a tubular standard telescopically mounted on the base, a plug in the top of the tubular standard, a plurality of outwardly extending brackets secured to the plug, a horizontal and substantially oblong open work frame carried by said brackets, and mechanical means to raise said standard.

U.S. Pat. No. 2,222,243 ('243 patent), which issued to Sandstrom, discloses a Portable Hoisting Jack. The '243 patent describes a hoisting jack of upstanding channel frame members having the channels thereof arranged in opposed relation, spacing members securing the channel members in spaced parallel relation, the lower ends of said channel members extending horizontally outwardly to provide supporting feet for the bottom of said channel members, a substantially U-shaped base having the end portions secured to the outer ends of said feet, braces extending from said base member to said channel members, wheels journalled on said base member and normally maintained out of ground-engaging position, said wheel members being adapted for engagement with the ground upon a tilting movement of said frame members and a work-engaging platform adjustably carried by said channel members.

Referencing U.S. Pat. No. 2,675,211 ('211 patent), which issued to Regoord, for example, discloses an Extensible Column. The '211 patent describes an extensible column comprising a plurality of tubular sections, one section comprising a fixed base section, a second section being arranged in and telescopically with the base section, a plurality of other sections telescoping in the second section and with each other.

Each of the sections of the '211 patent have upper ends whereat there extend circumferentially spaced arms, with sheaves on said sections at the inner ends of the arms, said sheaves operating in elongated apertures in adjacent sections in keying the sections against rotary movement one with respect to the other, the lower end of the second section having two pairs of sheaves, a pair of cables looped around said pairs of sheaves of the second section and passing around the sheaves at the upper ends of the base section, one end of said cables being fixed to the lower portion of the base section, a winding mechanism, and the other end of said cables being fixed to a member of said mechanism whereby, in the operation of said mechanism, the looped portions of said cables are reduced and said second section is raised in the base section.

U.S. Pat. No. 2,777,660 ('660 patent), which issued to Albrecht, discloses Adjustable Shores. The '660 patent describes an adjustable supporting column comprising a tubular lower section having the upper end thereof open, an upper section having a plurality of longitudinally spaced diametrical openings therethrough telescopically received in the open upper end portion of said tubular lower section for initial axial extending and retracting movements. An extension element is threadably engaged with the upper end portion of said lower section, and a collar overlies and engages said extension element having independent rotary and axial movement therewith on said upper section.

Certain operating means on said extension element rotate the same to provide vernier axial adjustment of said upper section through said collar, said collar having pairs of diametrically opposed longitudinally spaced step-like portions each pair of which provide a supporting surface selectively supporting the ends of a pin inserted through a selected opening in said upper section providing an intermediate axial adjustment of said upper section between said initial and vernier adjustments, aligned diametrical openings in said extension element alignable with a selected opening in the upper section for receiving means to secure the sections together for transportation or storage.

The '660 patent teaches a device having a beam supporting saddle as referenced at 5. Telescopic members that may be raised or lowered (in steps via the collar element 15), and pin-receiving apertures formed in the upper tubular element for preventing axial displacement of the upper tubular member relative to the lower tubular member.

U.S. Pat. No. 2,896,908 ('908 patent), which issued to Stone, discloses a Fluorescent Fixture Hoist. The '908 patent describes a lifting hoist comprising a base, a main cylinder secured to said base, a plurality of telescoping members adjustably supported upon said base for movement between a retracted and an extended position, (manually operated) means for selectively effecting said movement of said telescoping members, said manually operated means comprising a lift chain having a plurality of pivotally connected links. One end of said lift chain is connected to the inner one of said lift chain being connected to the inner one of said telescoping members. Drive means effect longitudinal movement of the opposite end of said lift chain, and means associated with adjacent ones of said links intermediate said one end of said lift chain and said drive means for rigidifying said pivotally connected links for exerting a compressive axial force therethrough.

Each of said links comprising a pair of identical sides each having a base and an inwardly offset end portion, an outermost and an innermost pin extending through the bases of each pair of sides, each said offset end portion defining a longitudinal slot and a terminal recess, said outermost pin being slidably and pivotally received with the longitudinal slots of the inwardly offset portions of the next adjacent link, and said terminal recesses displaceably receiving the innermost pin of said next adjacent link.

U.S. Pat. No. 3,026,090 ('090 patent), which issued to Anderson, discloses a Ceiling Material Hoist. The '090 patent describes a hoist for handling ceiling material and the like, comprising a base, a vertical post upstanding from said base, a tubular lifting standard surrounding and vertically slidable on said post, a guide member spaced above said base and extending about said lifting standard in slidable engagement with said standard, said standard being slidable up and down within said guide member, supporting means connecting said guide member and base, a material support carried by the upper end of said lifting standard, and winch means carried by said guide member at the outer side of said member and including a hoisting cable exterior to said lifting standard and operatively connected to the lower end portion of said lifting standard.

U.S. Pat. No. 3,158,354 ('354 patent), which issued to Ward, discloses a Lifting Device. The '354 patent describes a lifting device comprising a vertically directed post, said post having a substantially square cross section, a pulley rotatably mounted adjacent to the upper end of said post, a frame mounted for vertical movement upwardly and downwardly along said post, wherein said post extends vertically through said frame and is disposed diagonally with respect to said frame so that one corner of said post is directed toward the front of said frame and the diagonally opposite corner of said post is directed toward the rear of said frame.

Lifting means are carried by said frame for engaging an object to be lifted, and a first roller is rotatably mounted on said frame adjacent to the rear corner of said post. Said roller has a pair of inwardly directed right angular walls of substantially equal size forming a V adjacent to its center, said wall being disposed so as to engage both sides of said post simultaneously and equally adjacent to the rear corner thereof and to move vertically therealong.

A second roller is rotatably mounted on said frame adjacent to the front corner of said post on the opposite side of said post from said first roller. The second roller has a pair of inwardly directed right angular walls of substantially equal size forming a V adjacent to its center. The walls are disposed so as to engage both sides of said post simultaneously and equally adjacent to the front corner thereof and to move vertically therealong. A cable is attached at a lower end to said frame. A reel is rotatably mounted on the rear of said frame, the opposite end of said cable being attached to said reel, and means for rotating said reel to move said frame and lifting means vertically upwardly and downwardly along said post.

U.S. Pat. No. 3,861,647 ('647 patent), which issued to Meredith, discloses a Jack Structure. The '647 patent describes a jack which comprises an elongated hollow upright base section, an elongated tubular intermediate section mounted for telescopic movement inside the base section, an elongated inner section mounted for telescopic movement inside the intermediate section, a first pulley means mounted on a lower end portion of the intermediate section, second pulley means mounted on an upper end portion of the intermediate section, a winch mounted on the base section, cable means extending from the winch downwardly between the base section and the intermediate section and around the first pulley means, upwardly from the first pulley means to and over the second pulley means, and downwardly from the second pulley means to a cable anchor mounted on the inner section adjacent a lower end portion thereof, and means for turning the winch to cause raising of the inner and intermediate sections, the intermediate section and the inner section being provided with transverse alignable openings for receiving a pin to cause the inner and intermediate sections to move together, the inner section being raisable with respect to the intermediate section when the pin is removed and the winch is turned.

U.S. Pat. No. 4,508,316 ('316 patent), which issued to Millard, discloses a Cable Driven Jack. The '316 patent describes a jack, comprising: a base; a hollow upright member secured to and projecting from said base; a first support tube telescoped within said upright member; a second support tube telescoped within said first support tube; drive means carried by said upright and selectively engaging said first and second support tubes to move said tubes between retracted and extended positions with respect to said upright member at different speeds; and said drive means including a winch mounted on said upright member and a cable having one end secured to said winch; and attachment means carried by said first and second support tubes for releasably and selectively engaging the opposed end of said cable.

U.S. Pat. No. 4,757,975 ('975 patent), which issued to Gordon et al., describes a Long Travel Beam Jack. The '975 patent describes a jack for supporting a ceiling beam which comprises: a base member disposed upon a horizontal flat surface; a first support member retained at lower end by said base member in a vertical position; a first track member mounted transversely to upper end of said first support member; a second support member; a second track member mounted transversely to lower end of said second support member whereby said second track member can travel on said first support member while said second support member can travel within said first track member; a plate member for carrying the ceiling beam, said plate member being pivotly connected to upper end of said second support member; means mounted between said first track member and said second track member along side of said second support member for raising and lowering said second support member; a telescoping adjustment portion slidably extending upwardly therefrom, with said plate member pivotly connected to the upper end of said telescoping adjustment portion, said telescoping adjustment portion having a plurality of vertically spaced apart apertures therethrough; a locking pin extending through said second support member and any of the apertures in said telescoping adjustment portion to vary overall height of said jack; a winch mechanism suspended downwardly from said first track member, said winch mechanism includes a spool having a ratchet wheel formed on one flange of the spool and a pivotable arm having a pawl engageable with the ratchet wheel to turn the spool; a pulley suspended upwardly from said second track member; a cable attached at one end to bottom of said winch mechanism, extending around said pulley and winded around the spool of said winch mechanism for raising and lowering said second support member when said winch mechanism is manually activated by the pivotable arm thereof; a spring biased foot lever mounted to said base member; a plurality of rollers spaced apart and each of which is rotatably affixed to said base member, side of said first support member opposite from said second support member and top of said first track member; and an elongated second cable attached at one end to said foot lever, extending past said rollers with other end attached to distal end of the pivotable arm of said winch mechanism so that a person can operate said winch mechanism by foot control.

U.S. Pat. No. 6,942,198, ('198 patent), which issued to Huang, describes a Lifter. The '198 patent describes a lifter constructed to include a hollow main upright, a frame pivoted to the main upright to carry a hand winch, a link coupled between the frame and the main upright, a hollow auxiliary upright axially movably mounted in the hollow main upright, a lifting upright axially movably mounted in the hollow auxiliary upright, two first pulley blocks coupled between the hand winch and the hollow auxiliary upright and adapted to lift the hollow auxiliary upright upon operation of the hand winch, and two second pulley blocks coupled between the hollow main upright and the lifting upright and adapted to lift the lifting upright upon operation of the hand winch after the hollow auxiliary upright has been extended out of the hollow main upright.

U.S. Pat. No. 7,857,287 ('287 patent), which issued to Rucks, describes a Lifting Device. The '287 patent describes a lifting device which includes a jack having a first portion and a second portion movable relative to the first portion. A coupling is fixedly attached to the second portion for movement relative to the first portion, the coupling extending away from the second portion and having a configuration for selective attachment to a receiver hitch. The second portion may be moved relative to the first portion with a handle. The lifting device includes a sleeve coupled to the coupling for movement with the sleeve. Support tubing may extend through the sleeve for contact with the ground. This tubing may be locked into place relative to the sleeve. With the tubing, sleeve, and coupling locked into place, a vehicle will be upheld if the jack portions fail. The lifting device may also include a bumper attachment for raising a vehicle that does not have a receiver hitch.

It will be seen from a review of the foregoing in particular, and the field of load lifting means in general that the prior art perceives a need for a telescopic tube construction having means for lifting an inner tube of such construction relative to an outer tube of such construction via winch means connected to the inner tube for directing lifting force through a lengthwise slot formed in the outer tube construction. Accordingly, the present invention provides a lift apparatus of the foregoing type as summarized in more detail hereinafter.

SUMMARY OF THE INVENTION

The present invention essentially or summarily provides a long travel lift apparatus for enabling users to raise a structural load from a first position to a second position. The achieve this primary objective, the long travel lift apparatus according to the present invention preferably comprises a telescopic tube construction as at 20, and means for imparting a lift force to the inner tube 21 of the telescopic tube construction 20.

The telescopic tube construction 20 preferably comprises an inner tube as at 21 and an outer tube as at 22. The inner tube comprises a first tube diameter as at 100, and the outer tube comprises a second tube diameter as at 101. The first tube diameter 100 is lesser than the second tube diameter 101, and thus the inner and outer tubes 21 and 22 may be diametrically and telescopically nested. The inner tube comprises an upper inner tube end as at 23 and a lower inner tube end as at 24.

The means for imparting a lift force to the inner tube 21 of the telescopic tube construction 20, as preferably exemplified by a winch assembly 30 having geared transmission means, extends or lifts the inner tube 21 in an upwardly manner relative to the outer tube 22. The lift apparatus 14 is positionable in inferior adjacency to a structural load as exemplified by a roof assembly or structural cap as at 10. The means for imparting a lift force are firstly operable to lift the inner tube 21 relative to the outer tube 22 into engagement with the structural load as generally depicted in FIG. 4.

The means for imparting a lift force are secondly operable to lift the inner tube 21 relative to the outer tube 22 for transmitting lift force as at 107 into the structural load for lifting the structural load to a raised position in superior adjacency the first position as generally and comparatively depicted in FIG. 6. The raised position essentially defines a fillable space intermediate the first and second positions for receiving a secondary, load-bearing means as exemplified by a second, cap-supporting construction as at 13.

The upper inner tube end is cooperably associated with a load-receiving lift trough as at 25, which load-receiving lift trough 25 preferably comprises two upwardly extending parallel trough walls as at 26, and a trough bottom portion as at 27. The trough bottom portion 27 is preferably connected to the upper inner tube end 23 and further connects the parallel walls 26.

The free end of the inner member portion 35 of the tension member of the winch assembly 30 is preferably connected to the inner tube 21 via an outwardly extending plate member 40, which outwardly extending plate member 40 extends outwardly through the a lengthwise slot 38 formed in the outer tube 22. The outwardly extending plate member 40 is translatable within the slot 38 for enabling lifting force to be transmitted to the inner tube 21 via the tension member.

The outwardly extending plate member 40 further preferably extends across the inner diameter of the inner tube 21 and is attached to diametrically opposed portions (as at 41) of the inner tube 21 for enhancing the strength of the plate-to-tube junction site. The lengthwise slot 38 is outfitted or flanked with outwardly extending parallel guide plates as at 43. The parallel guide plates 43 function to protect the inner member portion 35 of the tension member and to reinforce the outer tube 22 during lifting operations.

The outer tube 22 and member guide plates 43 extending in a first dimension are outfitted with periodically lengthwise-spaced reinforcement rings or plates as at 44. The reinforcement rings or plates 44 extend in a second dimensional ring plane orthogonal to the parallel guide plates 43 for further reinforcing the outer tube 22 during lifting operations.

The load-receiving trough structure as exemplified by assembly 25 may further preferably comprise a downwardly extending male structure, the downwardly extending male structure as at 47 couples with a female structure(s) formed in a compression member as at 46. The male structure(s) are believed to enhance a user's ability to mate a compression member 46 with the load-receiving trough structure for enhancing the load-bearing characteristics (e.g. by adding stability and/or load-bearing force(s)) of the long travel lift apparatus 14.

In addition to the various structural aspects of the invention, it is believed that the foregoing specifications further support certain load-lifting methodological advancements or certain methods for lifting and/or supporting a load. In this regard, the load-lifting method according to the present invention is believed to enable a user to selectively lift or raise a structural load from a supported first position to a second raised position, and essentially comprises the initial step of providing at least one lift apparatuses.

Each lift apparatus comprises a telescopic tube construction and means for imparting a lift force. The telescopic tube construction comprises a translatable in inner tube construction and a sedentary outer tube construction. The means for imparting a lift force function to extend or lift the translatable inner tube construction relative to the sedentary outer tube construction.

Each lift apparatus may then be positioned in inferior adjacency to a supported structural load as exemplified by the roof assembly or structural cap construction depicted in the drawings submitted in support of this application. The means for imparting a lift force may then be firstly operated for imparting a lift force and for respectively lifting each inner tube relative to each outer tube for lifting each inner tube into engagement with the supported structural load.

A first support source (as exemplified by the wall construction(s) of the structural bottom 11) may then be removed from the supported structural load thereby transferring the structural load weight to the pre-positioned lift apparatus or lift apparatuses as the case may be. The means for imparting a lift force may then be secondly operated for imparting a second lift force for further lifting each inner tube relative to each outer tube and transmitting lift force into the structural load for lifting the structural load to a raised position.

As noted, the means for imparting a lift force may be preferably defined by a winch assembly, which winch assembly preferably comprises a tension member and geared transmission means. The tension member is wound round a rotatable drum, and a free end thereof is connected to the inner tube at a bottom portion thereof via a lengthwise slot formed in the outer tube. The load-lifting method may thus be said to further comprise the step of transmitting lift force through the lengthwise slot to the inner tube from the tension member during lifting operations.

BRIEF DESCRIPTION OF THE DRAWINGS

Other features and objects of my invention will become more evident from a consideration of the following brief descriptions of illustrations of the subject invention:

FIG. 9A is a top perspective view of a first telescopic tube construction according to the present invention in a collapsed state showing an extended inner tube and beam-receiving trough in broken lines.

FIG. 9B is a top perspective view of a second telescopic tube construction according to the present invention in an extended state showing the extended inner tube and beam-receiving trough in engagement with a cap support beam.

FIG. 9C is a fragmentary sectional view of the upper inner tube end outfitted with a beam-receiving trough showing optional downwardly extending cone-shaped male members for insertion in a female end of a compression, support, or stabilizing member according to the present invention.

DETAILED DESCRIPTION OF THE PREFERRED EMBODIMENT AND METHODOLOGY

Figure 1:
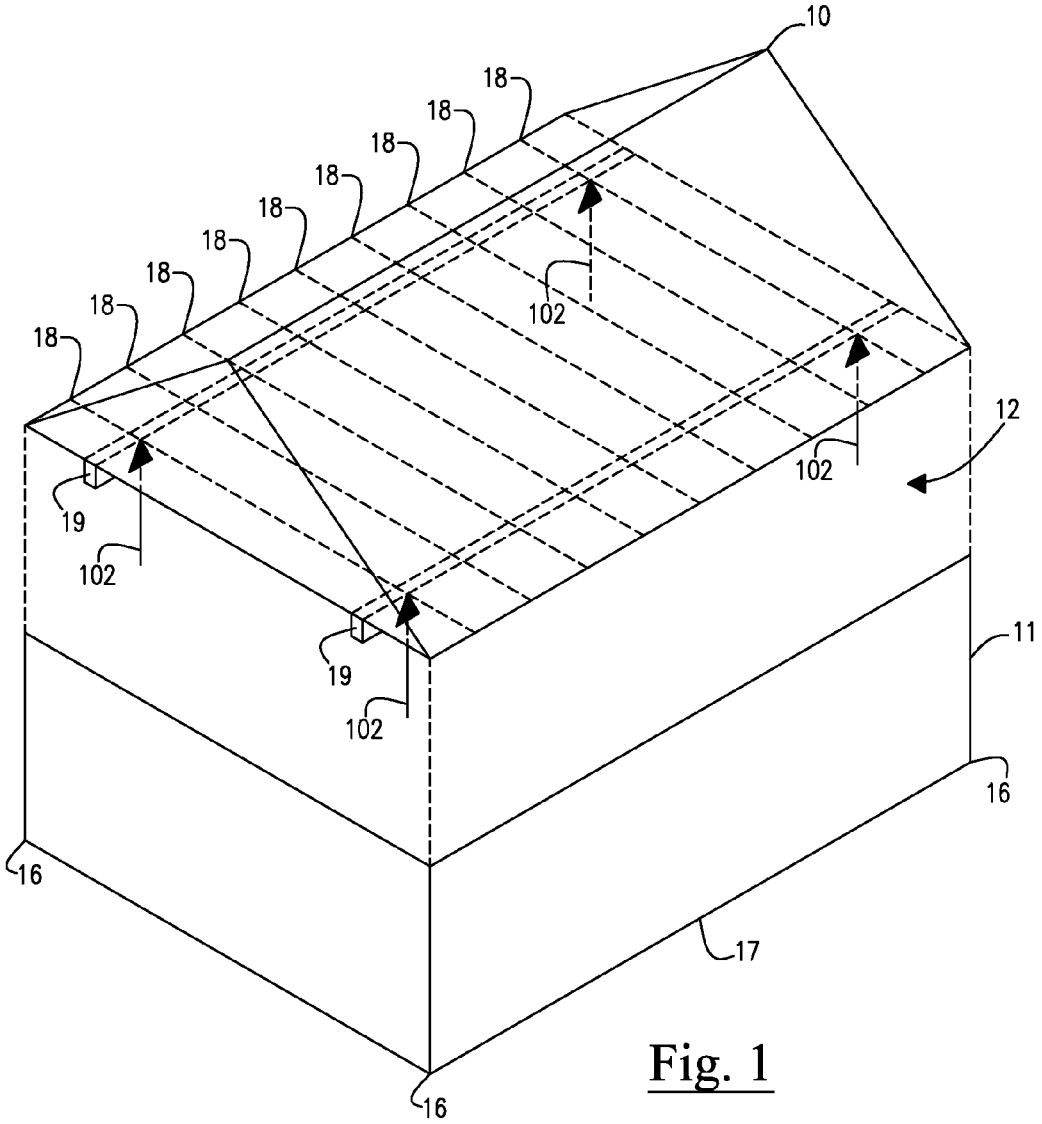
FIG. 1 is a top perspective view of an upper structural cap or roof construction raised relative to a lower structural bottom or wall construction with a fillable space therebetween, the fillable space being depicted as that volumetric space extending between the vertical broken lines.

Referring now to the drawings with more specificity, the present invention essentially provides a long travel lift system, apparatus, and/or method for enabling users to raise a structural load such as a structural cap as at 10 from a first load-supported position as exemplified by a structural bottom as at 11 for creating a fillable space as at 12 between the raised structural cap and fixed structural bottom for receiving a second, cap-supporting construction as at 13 intermediate the raised structural cap 10 and fixed structural bottom 11.

When viewed systemically, the long travel lift system according to the present invention preferably comprises a series of at least four lift apparatuses as at 14. Referencing FIG. 2 and comparing the same to FIG. 1, the reader will consider the upward diagrammatic view from the floor 17 of the structural bottom 11 showing a bottom plate 15 of each lift apparatus 14 positioned inwardly adjacent four structural corners 16 of the structural bottom 11 in inferior adjacency to the structural cap 10.

Figure 2:
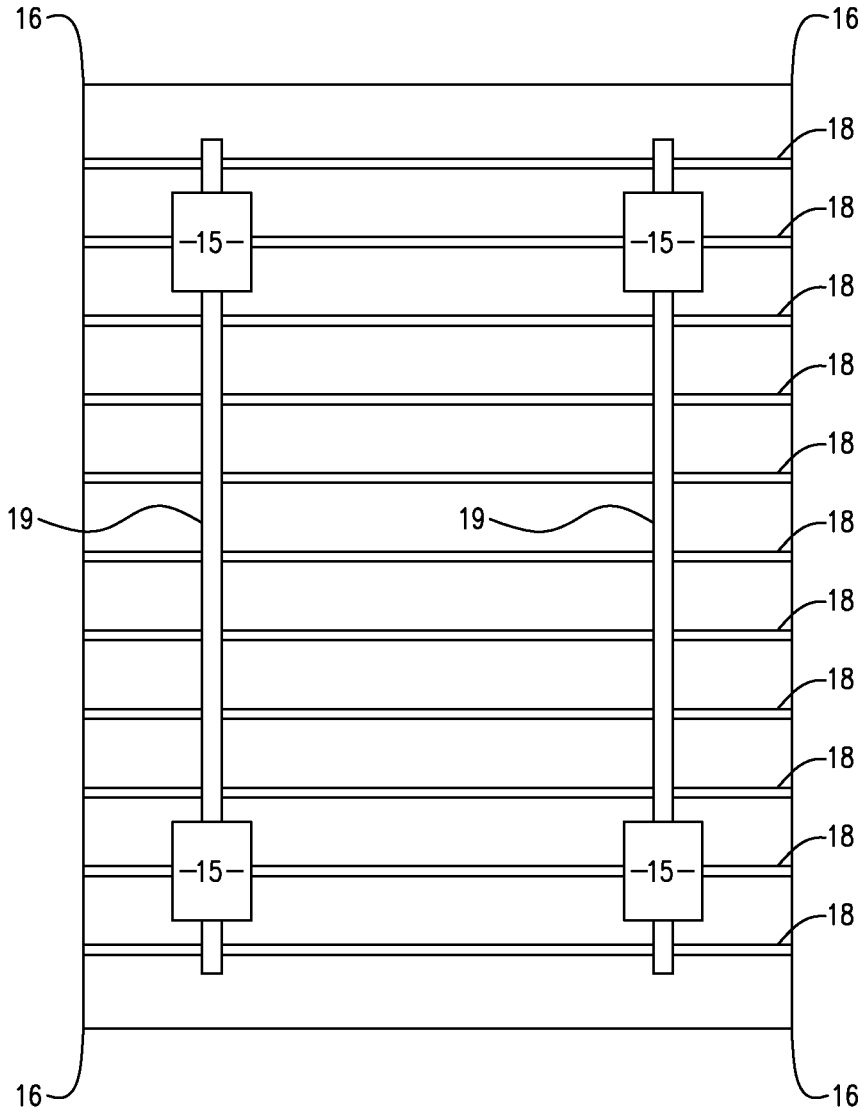
FIG. 2 is a diagrammatic depiction looking toward the structural cap from a floor view underneath four corner-spaced lift apparatuses according to the present invention to show relative placement of the lift apparatuses relative to the structural cap construction.

The plates 15 obscure the view of the operable portions of each lift apparatus 14 in FIG. 2. However, FIG. 2 is presented to show the reader the relative structural relationship of each lift apparatus 14 to the structural corners as well as the ceiling joists 18 and joist-support beams 19, which beams 19 preferably interface between each lift apparatus 14 and the joists 18 for transferring lift force from the lift apparatuses 14 to the structural cap 10. At least two lift apparatuses 14 are preferably spaced lengthwise in inferior adjacency to each of the parallel cap support beams 19.

Each lift apparatus 14 preferably comprises a telescopic tube construction as at 20 and certain means for imparting a lift force to an inner tube 21 of the telescopic tube construction 20. The means for imparting a lift force basically function to lift and/or extend the inner tube 21 relative to an outer tube 22 of the telescopic tube construction 20. The inner tube 21 thus comprises a first tube diameter as at 100, and the outer tube 22 comprising a second tube diameter as at 101.

The first tube diameter 100 is lesser than the second tube diameter 101, and thus the inner tube 21 and the outer tube 22 are diametrically and telescopically nested relative to one another as is well understood in the art(s). The inner tube 21 comprises an upper inner tube end as at 23, and a lower inner tube end as at 24. The outer tube 22 comprises an upper outer tube end as at 60, a lower outer tube end as at 61, and a lengthwise slot as at 38.

The upper inner tube end 23 preferably comprises, is outfitted with, or receives a load -receiving or beam-receiving lift trough assembly as at 25. The beam-receiving lift trough assembly 25 preferably comprises two upwardly extending parallel walls as at 26, a bottom portion as at 27, and a male extension as at 28. The bottom portion 27 is preferably connected (optionally welded) to the upper inner tube end 23 and connects the parallel walls 26. The means for imparting a lift force are firstly operable to lift the inner tube 21 relative to the outer tube 22 thereby lifting the beam-receiving trough structures or assemblies 25 into engagement with the cap support beams 19 for providing at least four secondary points of structural cap support as at 102.

Figure 5:
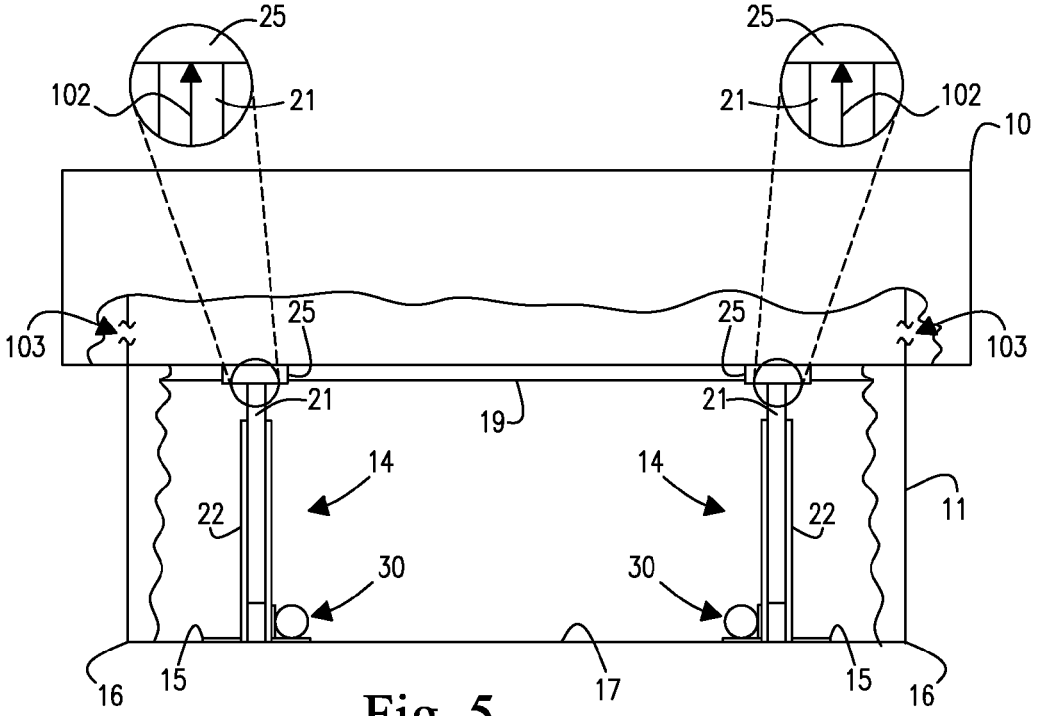
FIG. 5 is a third sequential diagrammatic depiction of a structural cap (with parts broken away) as separated from the structural bottom with parts broken away to show two spaced lift apparatuses according to the present invention supporting the separated structural cap at the first position.
Figure 6:
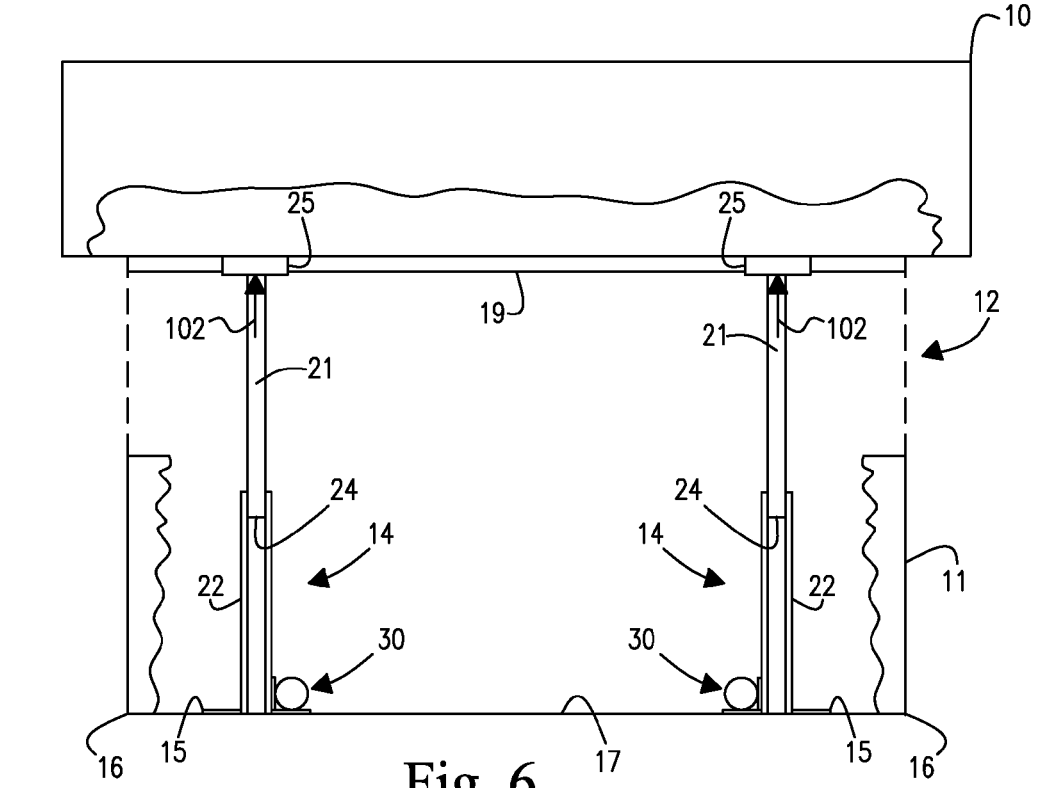
FIG. 6 is a fourth sequential diagrammatic depiction of a structural cap (with parts broken away) as separated from the structural bottom with parts broken away to show two spaced lift apparatuses according to the present invention raising the lift-supported separated structural cap to a second raised position for defining a fillable space between the raised structural cap and the structural bottom.
Figure 7:
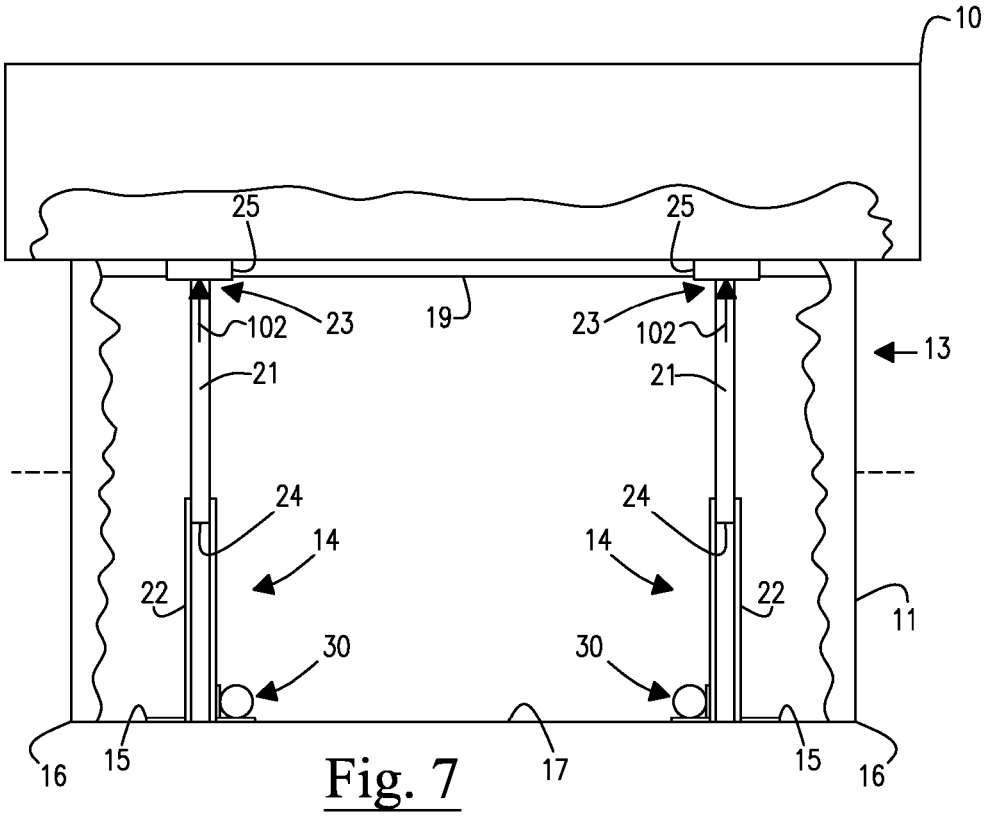
FIG. 7 is a fifth sequential diagrammatic depiction of a structural cap (with parts broken away) as separated from the structural bottom with parts broken away to show two spaced lift apparatuses according to the present invention supporting the separated structural cap at the second raised position with the fillable space having been filled with a second, cap-supporting construction for further supporting the structural cap when the inner tubes are retracted.

The structural cap 10 is separable (as at 103) from the structural bottom 11 and supportable by the secondary points 102 of structural cap support as generally depicted in FIG. 5. The means for imparting a lift force are then secondly operable to further lift the inner tube 21 relative to the outer tube 22 for transmitting lift force into the structural cap 10 via the cap support beams 19 for lifting the structural cap 10 to a second raised position as generally depicted in FIG. 6 in superior adjacency the structural bottom 11. The second raised position as generally depicted in FIG. 6 essentially defines a fillable space as at 12 intermediate the structural cap 10 and the structural bottom 11 for receiving the second, cap-supporting construction as at 13 depicted in FIG. 7.

Figure 3:
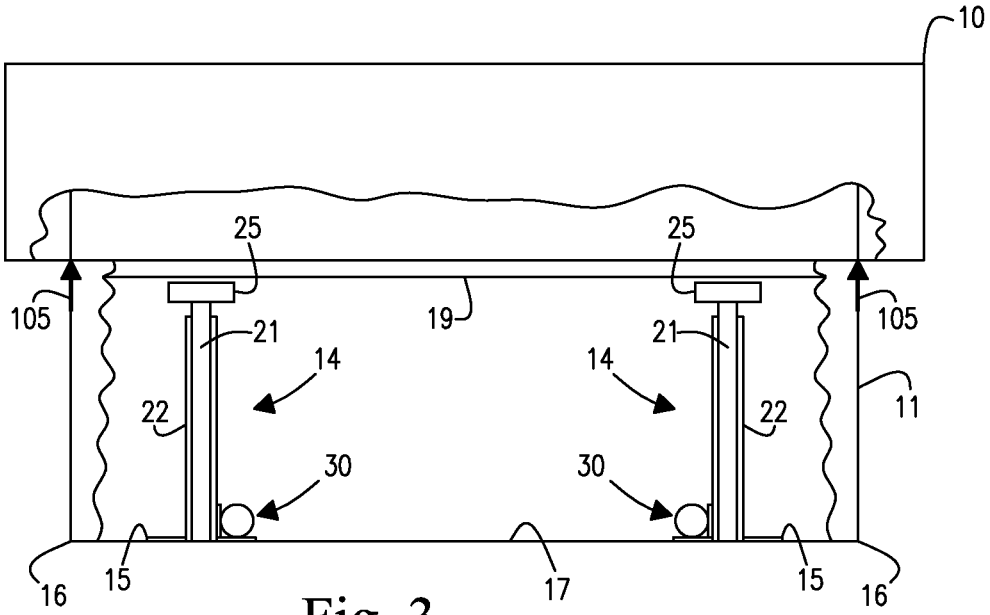
FIG. 3 is a first sequential diagrammatic depiction of a structural cap (with parts broken away) as supported in a first position by structural bottom with parts broken away to show two spaced lift apparatuses according to the present invention positioned in inferior adjacency to the structural cap prior to engagement with a cap-support beam.
Figure 8:
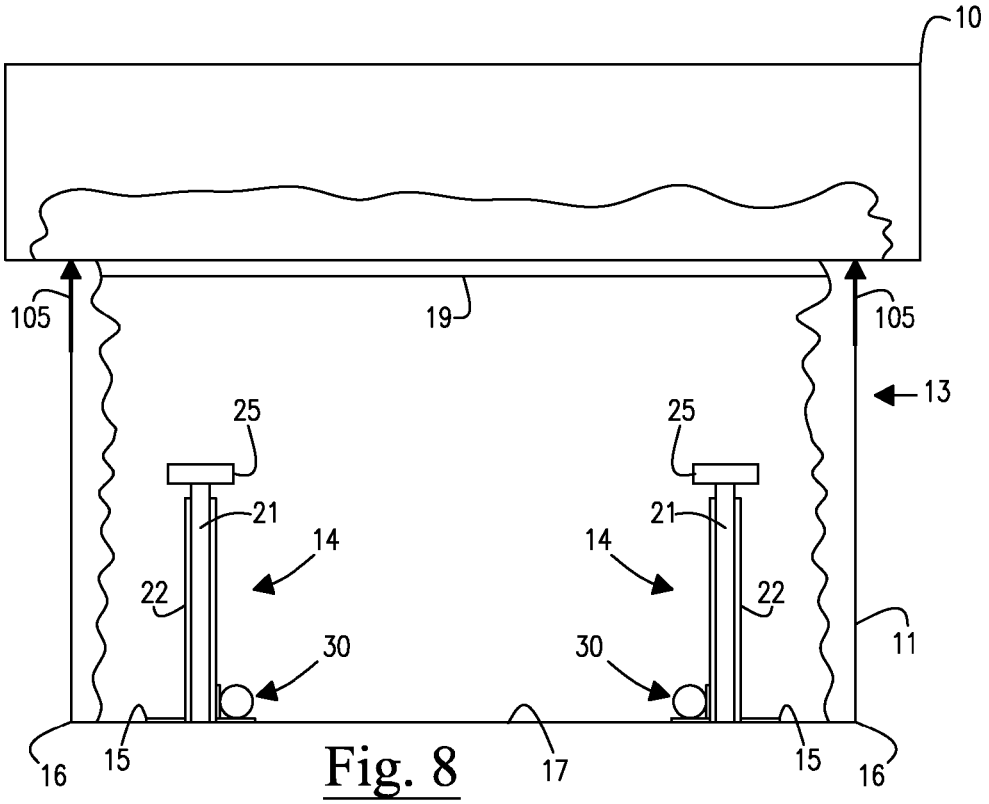
FIG. 8 is a sixth sequential diagrammatic depiction of a structural cap (with parts broken away) as separated from the structural bottom with parts broken away to show two spaced lift apparatuses according to the present invention with the inner tubes having been retracted, the structural cap being supported at the second raised position via a second, cap-supporting construction.
Figure 10:
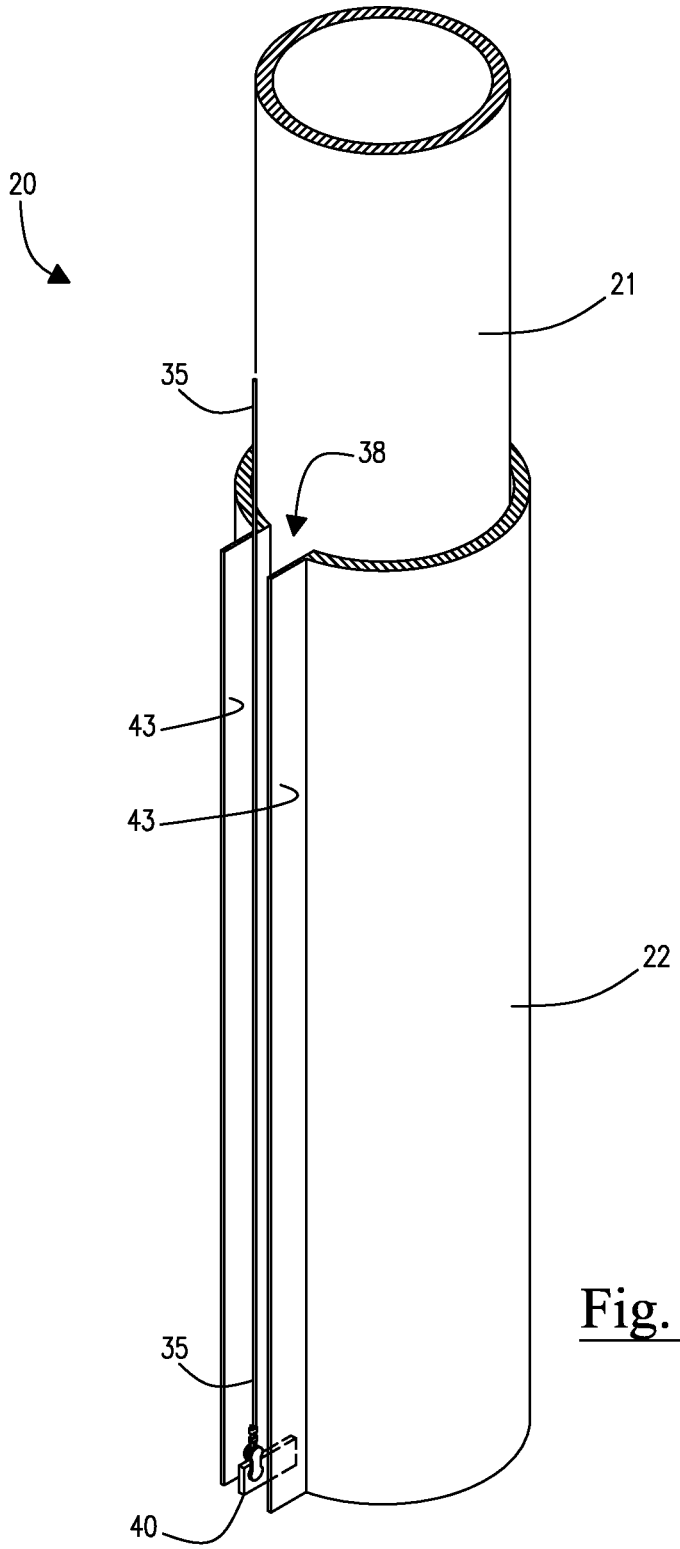
FIG. 10 is an enlarged, fragmentary, top perspective view of a partial outer tube and an partial inner tube of the telescopic tube construction according to the present invention with parts broken away to show the relative diameters of the outer and inner tubes and to further highlight the lengthwise slot formed in the outer tube.

The second, cap-supporting construction 13 functions to bear the load of the structural cap as at arrows 105. Comparing FIGS. 3 and 4 with FIGS. 7 and 8, the reader will note that the structural bottom firstly bears the load of the structural cap as at 105 and that the structural bottom and second, cap-supporting construction 13 together bear the load of the structural cap 10 as at 105 following the construction of the second, cap-supporting construction 13 enabled by way of the long travel lift system and apparatuses 14 according to the present invention.

The means for imparting a lift force according to the present invention may be preferably defined or exemplified by a winch assembly as at 30. The winch assembly 30 essentially comprises a tension member, which member has an outer member portion as at 31 and an inner member portion as at 35. The outer member portion 31 is wound round a rotatable drum as at 32. The inner member portion 35 has a free end that connects to the lower inner tube end 24. A motor 33 operates to create a turning force as at 104 upon the drum 32. The axis of rotation about which a preferred first gear 34 turns is depicted at 106 in FIG. 12.

Figure 12:
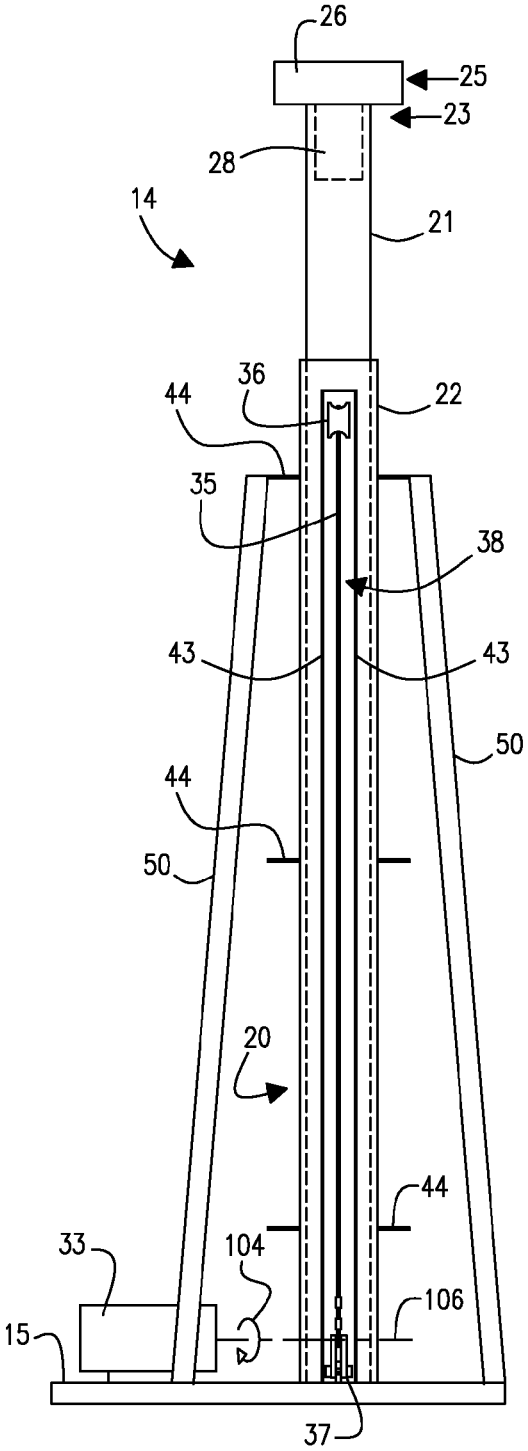
FIG. 12 is an anterior or frontal elevational view of the lift apparatus according to the present invention with parts of a winch assembly broken away or removed to enhance the clarity of the lower tube construction.
Figure 13:
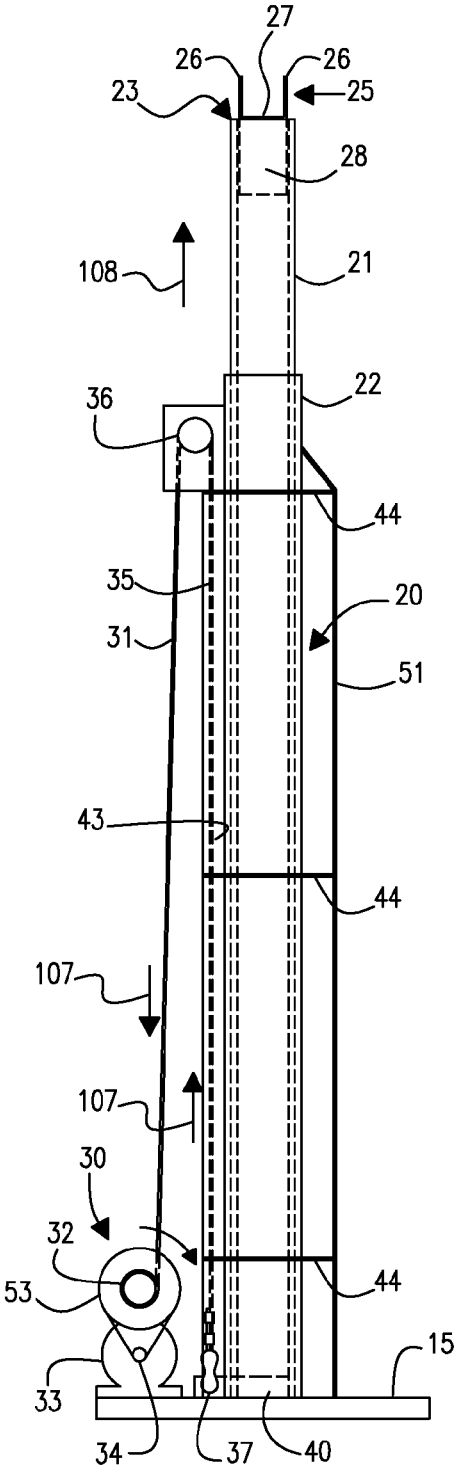
FIG. 13 is a lateral elevational view of the lift apparatus according to the present invention.

Referencing FIG. 12, the reader will please note that the rotatable drum 32 has been omitted or removed from the drawing so that the reader can more clearly see the bottom end of the telescopic tube construction 20 at which bottom end the free end of the inner member portion 35 attaches to the inner tube 21. The outer member portion 31 extends upwardly from the drum 32 over a pulley assembly 36 mounted to the outside surfacing of the outer tube 22. The inner member portion 35 extends downwardly from the pulley assembly 36 to the lower inner tube end 24 at which end 24 the free end of the inner member portion 35 is attached via a rigging assembly 37.

The first gear 34 is preferably in communication with a second gear 53 for providing certain geared transmission means for providing the user with enhanced control over the rotational speed of the drum 32. Comparatively referencing Figure Nos. 10-13, the reader will please further note that the outer tube 22 preferably comprises a lengthwise slot as at 38. The lengthwise slot 38 is preferably open (as at 62) at the lower outer tube end 61 and closed at the upper outer tube end 60 at an upper slot terminus 39.

The lengthwise slot 38 essentially enables the lifting force as at 107 to be transmitted to the inner tube 21 via the tension member having outer and inner member portions 31 and 35. The inner member portion 35 of the tension member is preferably connected to the lower inner tube end 24 of the inner tube 21 via an outwardly extending plate member 40. The plate member 40 preferably extends outwardly through the lengthwise slot 38 and is translatable therebetween in an up and down manner for enabling the lifting force to be transmitted to the inner tube via the tension member for extending (as at 108) the inner tube 21 relative to the outer tube 22.

Figure 11:
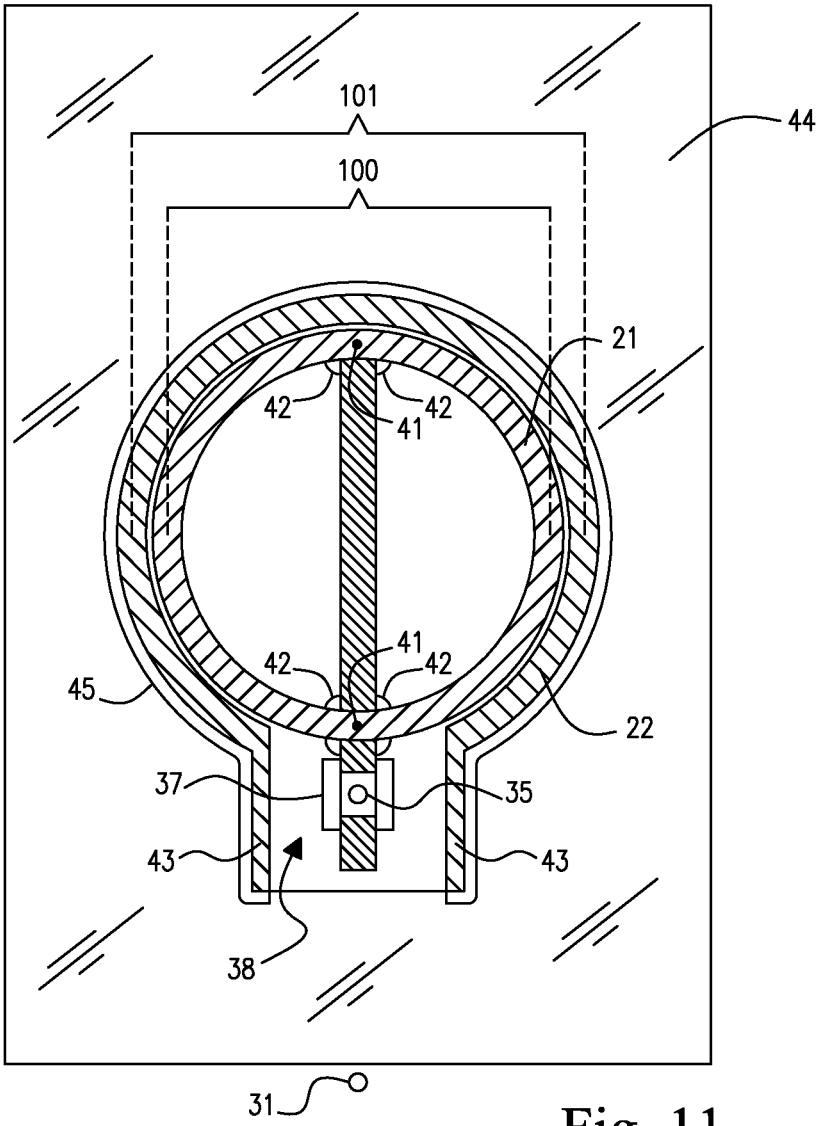
FIG. 11 is an enlarged, fragmentary, transverse cross-sectional view of the outer and inner tubes of the telescopic tube construction according to the present invention further showing (1) a planar tube-reinforcement ring or plate surrounding the tube construction, (2) a diametrically extended plate member attached to the bottom end of the inner tube, and (3) transverse sectional views of the inner and outer member portions of the force-transmitting tension member.

From an inspection of FIG. 11, the reader will see that the plate member 40 preferably extends across the inner diameter of the inner tube 21 and is attached to diametrically opposed portions 41 of the inner tube 21 for enhancing the strength of the plate-to-tube junction. In this regard, the reader will note spot welds 42 help fasten the plate 40 to the inner tube 21. The reader will further note that the lengthwise slot 38 is preferably outfitted with flanking, outwardly-extending parallel guide plates as at 43. The flanking, outwardly-extending, parallel guide plates 43 basically function to protect or shield the tension member during lifting operations and further function to reinforce the outer tube 22 during lifting operations.

Keeping in line with the notion of reinforcement, the outer tube 22 and member guide plates 43 are further preferably outfitted with periodically lengthwise-spaced reinforcement rings or plates as at 44 welded as at 45 to the outer surfacing of the outer tube 22 and plates 43. The reinforcement rings or plates 44 extend in a ring planes orthogonal to the parallel guide plates 43. The pulley assembly 36 may be simultaneously mounted to the uppermost ring or plate 44 for reinforcing its attachment point.

A series of compression members as at 46 may be used in combination with a series of lift apparatuses 14 to add compressive, load-bearing strength to the overall system. In this regard, it is contemplated that the load-receiving or beam-receiving trough structures 25 may each preferably comprise certain (cone-shaped) downwardly extending male structure as at 47 for insertion in upper female structure formed in each of the compression members 46. The downwardly extending male structures 47 couple with female structure(s) formed in each of the compression members 46. The compression members 46 are thus matable with the beam-receiving trough structures 25 for enhancing the load-bearing characteristics of the long travel lift system.

Referencing FIGS. 9A and 9B, the reader will note that the inner tube 21 and the outer tube 22 preferably comprise cooperable means for translatably fixing the inner tube 21 relative to the outer tube 22 further for enhancing the load-bearing characteristics of the system. In this regard, it is contemplated that the cooperable means may be preferably exemplified by a series of pin-receiving apertures 48 formed in the inner tube 21 and a pin member 49 may be inserted through a select set of (diametrically opposed) pin-receiving apertures 48 formed in the inner tube 21 which pin may then extend across the upper end 49 of the outer tube 22 for preventing backward or downward axial displacement of the inner tube 21 relative to the outer tube 22.

Further means for reinforcing the outer tube 22 may be preferably exemplified by laterally opposed, obliquely-extending upright members 50 and a posterior angled flat member as at 51. The angled flat member 51 is preferably fastened (welded) to the rings or plates 44 for enhancing the overall strength and stability of the lift apparatus 14. While the foregoing specifications set forth much specificity, the same should not be construed as setting forth limits to the invention but rather as setting forth certain preferred embodiments and features.

For example, as prefaced hereinabove, it is contemplated that the present invention essentially provides a long travel lift apparatus for enabling users to raise a structural load from a first position to a second position. The achieve this primary objective, the long travel lift apparatus according to the present invention preferably comprises a telescopic tube construction as at 20, and means for imparting a lift force to the inner tube 21 of the telescopic tube construction 20.

The telescopic tube construction 20 preferably comprises an inner tube as at 21 and an outer tube as at 22. The inner tube comprises a first tube diameter as at 100, and the outer tube comprises a second tube diameter as at 101. The first tube diameter 100 is lesser than the second tube diameter 101, and thus the inner and outer tubes 21 and 22 may be diametrically and telescopically nested. The inner tube comprises an upper inner tube end as at 23 and a lower inner tube end as at 24.

Figure 4:
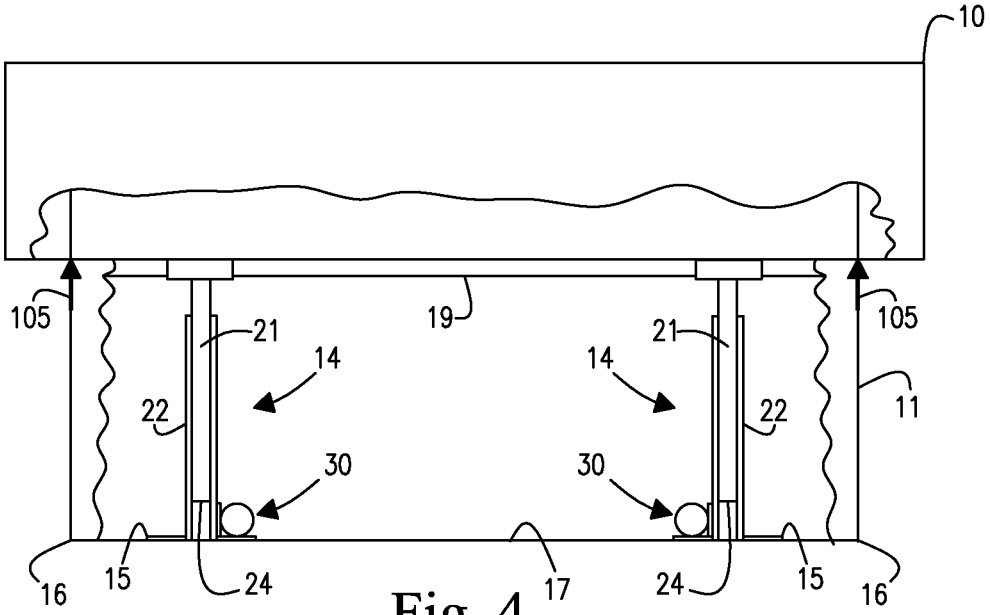
FIG. 4 is a second sequential diagrammatic depiction of a structural cap (with parts broken away) as supported in a first position by structural bottom with parts broken away to show two spaced lift apparatuses according to the present invention positioned in inferior adjacency to the structural cap with the inner tube raised to engage the cap-support beam.

The means for imparting a lift force to the inner tube 21 of the telescopic tube construction 20, as preferably exemplified by a winch assembly 30 having geared transmission means, extends or lifts the inner tube 21 in an upwardly manner relative to the outer tube 22. The lift apparatus 14 is positionable in inferior adjacency to a structural load as exemplified by a roof assembly or structural cap as at 10. The means for imparting a lift force are firstly operable to lift the inner tube 21 relative to the outer tube 22 into engagement with the structural load as generally depicted in FIG. 4.

The means for imparting a lift force are secondly operable to lift the inner tube 21 relative to the outer tube 22 for transmitting lift force as at 107 into the structural load for lifting the structural load to a raised position in superior adjacency the first position as generally and comparatively depicted in FIG. 6. The raised position essentially defines a fillable space intermediate the first and second positions for receiving a secondary, load-bearing means as exemplified by a second, cap-supporting construction as at 13.

The upper inner tube end is cooperably associated with a load-receiving lift trough as at 25, which load-receiving lift trough 25 preferably comprises two upwardly extending parallel trough walls as at 26, and a trough bottom portion as at 27. The trough bottom portion 27 is preferably connected to the upper inner tube end 23 and further connects the parallel walls 26.

The free end of the inner member portion 35 of the tension member of the winch assembly 30 is preferably connected to the inner tube 21 via an outwardly extending plate member 40, which outwardly extending plate member 40 extends outwardly through the a lengthwise slot 38 formed in the outer tube 22. The outwardly extending plate member 40 is translatable within the slot 38 for enabling lifting force to be transmitted to the inner tube 21 via the tension member.

The outwardly extending plate member 40 further preferably extends across the inner diameter of the inner tube 21 and is attached to diametrically opposed portions (as at 41) of the inner tube 21 for enhancing the strength of the plate-to-tube junction site. The lengthwise slot 38 is outfitted or flanked with outwardly extending parallel guide plates as at 43. The parallel guide plates 43 function to protect the inner member portion 35 of the tension member and to reinforce the outer tube 22 during lifting operations.

The outer tube 22 and member guide plates 43 extending in a first dimension are outfitted with periodically lengthwise-spaced reinforcement rings or plates as at 44. The reinforcement rings or plates 44 extend in a second dimensional ring plane orthogonal to the parallel guide plates 43 for further reinforcing the outer tube 22 during lifting operations.

The load-receiving trough structure as exemplified by assembly 25 may further preferably comprise a downwardly extending male structure, the downwardly extending male structure as at 47 couples with a female structure(s) formed in a compression member as at 46. The male structure(s) are believed to enhance a user's ability to mate a compression member 46 with the load-receiving trough structure for enhancing the load-bearing characteristics (e.g. by adding stability and/or load-bearing force(s)) of the long travel lift apparatus 14.

In addition to the various structural aspects of the invention, it is believed that the foregoing specifications further support certain load-lifting methodological advancements or certain methods for lifting and/or supporting a load. In this regard, the load-lifting method according to the present invention is believed to enable a user to selectively lift or raise a structural load from a supported first position to a second raised position, and essentially comprises the initial step of providing at least one lift apparatuses.

Each lift apparatus comprises a telescopic tube construction and means for imparting a lift force. The telescopic tube construction comprises a translatable in inner tube construction and a sedentary outer tube construction. The means for imparting a lift force function to extend or lift the translatable inner tube construction relative to the sedentary outer tube construction.

Each lift apparatus may then be positioned in inferior adjacency to a supported structural load as exemplified by the roof assembly or structural cap construction depicted in the drawings submitted in support of this application. The means for imparting a lift force may then be firstly operated for imparting a lift force and for respectively lifting each inner tube relative to each outer tube for lifting each inner tube into engagement with the supported structural load.

A first support source (as exemplified by the wall construction(s) of the structural bottom 11) may then be removed from the supported structural load thereby transferring the structural load weight to the pre-positioned lift apparatus or lift apparatuses as the case may be. The means for imparting a lift force may then be secondly operated for imparting a second lift force for further lifting each inner tube relative to each outer tube and transmitting lift force into the structural load for lifting the structural load to a raised position.

As noted, the means for imparting a lift force may be preferably defined by a winch assembly, which winch assembly preferably comprises a tension member and geared transmission means. The tension member is wound round a rotatable drum, and a free end thereof is connected to the inner tube at a bottom portion thereof via a lengthwise slot formed in the outer tube. The load-lifting method may thus be said to further comprise the step of transmitting lift force through the lengthwise slot to the inner tube from the tension member during lifting operations.

Accordingly, although the present invention has been described by reference to certain preferred arrangements and certain methodologies, it is not intended that the novel arrangements and methods be limited thereby, but that modifications thereof are intended to be included as falling within the broad scope and spirit of the foregoing disclosures, the following claims, and the appended drawings.

I claim:

1. A long travel lift system for enabling users to raise a structural cap from a structural bottom for creating a fillable space therebetween, the fillable space for receiving a second, cap-supporting construction intermediate the structural cap and structural bottom, the long travel lift system comprising, in combination:

a series of at least four lift apparatuses, each lift apparatus comprising a telescopic tube construction and means for imparting a lift force, said means comprising a series of tension members, each telescopic tube construction comprising an inner tube and an outer tube, each inner tube comprising an upper inner tube end and a lower inner tube end, each outer tube comprising an upper outer tube end, a lower outer tube end, and a lengthwise slot, each lengthwise slot being open at the lower outer tube end and closed at the upper outer tube end at an upper slot terminus, the tension members being coupled to the lower inner tube ends via the lengthwise slots for enabling transmission of lift force to the inner tubes from said means for imparting a lift force via the tension members, each upper inner tube end comprising a beam-receiving lift trough, each beam-receiving lift trough comprising two upwardly extending parallel trough walls and a trough bottom portion, each respective trough bottom portion connecting the parallel walls, the lift apparatuses being positionable inwardly adjacent four structural corners of the structural bottom in inferior adjacency to the structural cap, at least two lift apparatuses being spaced lengthwise in inferior adjacency to each of two parallel cap support beams supporting the structural cap, the means for imparting a lift force being firstly operable to lift the inner tubes relative to the outer tubes for lifting the beam-receiving troughs into engagement with the cap support beams for providing at least four secondary points of structural cap support, the structural cap being separable from the structural bottom and supportable by the secondary points of structural cap support, the means for imparting a lift force being secondly operable to lift the inner tubes relative to the outer tubes for transmitting lift force into the structural cap via the cap support beams for lifting the structural cap to a raised position in superior adjacency the structural bottom, the raised position defining the fillable space intermediate the structural cap and the structural bottom for receiving the second, cap-supporting construction.

2. The long travel lift system of claim 1 wherein the tension members are connected to the lower inner tube ends via outwardly extending plate members, the plate members extending through the lengthwise slots and being translatable therebetween.

3. The long travel lift system of claim 2 wherein each respective plate member further extends across the inner diameter of each respective inner tube and is attached to diametrically opposed portions of each respective inner tube for enhancing the strength of plate-to-tube junctions.

4. The long travel lift system of claim 1 wherein each respective lengthwise slot is flanked by outwardly extending parallel guide plates, the parallel guide plates for protecting the tension members and for reinforcing the outer tubes during lifting operations.

5. The long travel lift system of claim 4 wherein the outer tubes and member guide plates are outfitted with periodically spaced reinforcement rings, the reinforcement rings extending in a ring planes orthogonal to the parallel guide plates, the reinforcement rings for protecting the tension members and for reinforcing the outer tubes during lifting operations.

6. The long travel lift system of claim 1 comprising a series of compression members and wherein the beam-receiving troughs each comprise a downwardly extending male structure, the downwardly extending male structures for coupling with female structure(s) formed in each of the compression members, the compression members thus being matable with the beam-receiving troughs for enhancing the load-bearing characteristics of the long travel lift system.

7. The long travel lift system of claim 1 wherein the means for imparting a lift force comprise geared transmission means, the geared transmission means for enhancing the user's ability to impart force.

8. The long travel lift system of claim 1 wherein the inner and outer tubes comprise cooperable means for translatably fixing the inner tube relative to the outer tube, said cooperable means thus for enhancing the load-bearing characteristics of the system.

9. A long travel lift apparatus for enabling users to raise a structural load from a first position to a second position, the long travel lift apparatus comprising:

a telescopic tube construction, the telescopic tube construction comprising an inner tube and an outer tube, the inner tube comprising an upper inner tube end and a lower inner tube end, the outer tube comprising an upper outer tube end, a lower outer tube end, and a lengthwise slot, the lengthwise slot being open at the lower outer tube end and closed at the upper outer tube end at an upper slot terminus; and means for imparting a lift force to the inner tube for lifting the inner tube in an upwardly manner relative to the outer tube, said means comprising a tension member, the tension member being coupled to the lower inner tube end via the lengthwise slot for enabling transmission of lift force to the inner tube from said means for imparting a lift force via the tension member, the lift apparatus being positionable in inferior adjacency to a structural load, the means for imparting a lift force being firstly operable to lift the inner tube relative to the outer tube into engagement with the structural load, the means for imparting a lift force being secondly operable to lift the inner tube relative to the outer tube for transmitting lift force into the structural load for lifting the structural load to a raised position.

10. The long travel lift apparatus of claim 9 wherein the upper inner tube end is cooperably associated with a load-receiving lift trough, the load-receiving lift trough comprising two upwardly extending parallel trough walls and a trough bottom portion, the trough bottom connecting the parallel trough walls.

11. The long travel lift apparatus of claim 9 wherein the tension member is connected to the lower inner tube end via an outwardly extending plate member, the plate member extending through the lengthwise slot and being translatable therebetween.

12. The long travel lift apparatus of claim 11 wherein the plate member further extends across the inner diameter of the lower inner tube end and is attached to diametrically opposed portions of the inner tube for enhancing the strength of a plate-to-tube junction.

13. The long travel lift apparatus of claim 9 wherein the lengthwise slot is flanked by outwardly extending parallel guide plates, the parallel guide plates for protecting the tension member and for reinforcing the outer tube during lifting operations.

14. The long travel lift apparatus of claim 13 wherein the outer tube is outfitted with reinforcement means, the reinforcement means for reinforcing the outer tube during lifting operations.

15. The long travel lift apparatus of claim 10 wherein the load-receiving trough comprises a downwardly extending male structure, the downwardly extending male structure for coupling with a female structure formed in a compression member, the downwardly extending male structure thus for enhancing a user's ability to mate a compression member with the load-receiving trough for enhancing the load-bearing characteristics of the long travel lift apparatus.

16. The long travel lift system of claim 9 wherein the means for imparting a lift force comprise geared transmission means, the geared transmission means for enhancing the user's ability to impart lift force.

17. A long travel lift system for enabling users to raise a structural cap from a structural bottom for creating a fillable space therebetween, the fillable space for receiving a second, cap-supporting construction intermediate the structural cap and structural bottom, the long travel lift system comprising, in combination:

a series of at least four lift apparatuses, each lift apparatus comprising a telescopic tube construction and means for imparting a lift force, said means comprising a series of tension members, the tube constructions each comprising an inner tube and an outer tube, the inner tubes each comprising an upper inner tube end and a lower inner tube end, the lower inner tube ends each comprising an outwardly extending plate member, the outer tubes each comprising a lengthwise slot, the plate members extending through the lengthwise slots and being translatable therebetween, the tension members being connected to the lower inner tube ends via the plate members, the lengthwise slots and plate members thus for enabling transmission of lift forces to the inner tubes from said means via the tension members, the upper inner tube ends each comprising a beam-receiving lift trough, the beam-receiving lift troughs each comprising two upwardly extending parallel trough walls and a trough bottom portion, the trough bottom portions connecting the parallel walls, the lift apparatuses being positionable inwardly adjacent four structural corners of the structural bottom in inferior adjacency to the structural cap, at least two lift apparatuses being spaced lengthwise in inferior adjacency to each of two parallel cap support beams supporting the structural cap, the means for imparting a lift force being firstly operable to lift the inner tubes relative to the outer tubes for lifting the beam-receiving troughs into engagement with the cap support beams for providing at least four secondary points of structural cap support, the structural cap being separable from the structural bottom and supportable by the secondary points of structural cap support, the means for imparting a lift force being secondly operable to lift the inner tubes relative to the outer tubes for transmitting lift forces into the structural cap via the cap support beams for lifting the structural cap to a raised position in superior adjacency the structural bottom, the raised position defining the fillable space intermediate the structural cap and the structural bottom for receiving the second, cap-supporting construction.

18. The long travel lift system of claim 17 wherein the respective plate members further extends across the inner diameter of the inner tubes and are attached to diametrically opposed portions of the inner tubes for enhancing the strength of plate-to-tube junctions.

19. The long travel lift system of claim 17 wherein the lengthwise slots are each flanked by outwardly extending parallel guide plates, the parallel guide plates for protecting the tension members and for reinforcing the outer tubes during lifting operations.

20. The long travel lift system of claim 19 wherein the outer tubes and member guide plates are outfitted with periodically spaced reinforcement rings, the reinforcement rings extending in a ring planes orthogonal to the parallel guide plates, the reinforcement rings for protecting the tension members and for reinforcing the outer tubes during lifting operations.

21. The long travel lift system of claim 17 comprising a series of compression members and wherein the beam-receiving troughs each comprise a downwardly extending male structure, the downwardly extending male structures for coupling with female structure(s) formed in each of the compression members, the compression members thus being matable with the beam-receiving troughs for enhancing the load-bearing characteristics of the long travel lift system.

22. The long travel lift system of claim 17 wherein the means for imparting a lift force comprise geared transmission means, the geared transmission means for enhancing the user's ability to impart force.

23. The long travel lift system of claim 17 wherein the inner and outer tube comprise cooperable means for translatably fixing the inner tube relative to the outer tube, said cooperable means thus for enhancing the load-bearing characteristics of the system.

24. A long travel lift apparatus for enabling users to raise a structural load, the long travel lift apparatus comprising:

a telescopic tube construction, the telescopic tube construction comprising an inner tube and an outer tube, the inner tube comprising an upper inner tube end and a lower inner tube end, the lower inner tube end comprising an outwardly extending member, the outer tube comprising a lengthwise slot, the outwardly extending member extending through the lengthwise slot and being translatable therebetween; and means for imparting a lift force, said means comprising a tension member, the tension member being connected to the outwardly extending member, the lengthwise slot and outwardly extending member thus for enabling transmission of the lift force to the inner tube from the means for imparting a lift force via the tension member, the long travel lift apparatus being positionable in inferior adjacency to a structural load, the means for imparting a lift force being operable to (a) lift the inner tube relative to the outer tube into engagement with the structural load, and (b) lift the inner tube relative to the outer tube for transmitting lift force into the structural load for lifting the structural load to a raised position.

25. The long travel lift apparatus of claim 24 wherein the upper inner tube end is cooperably associated with a load-receiving lift trough, the load-receiving lift trough comprising two upwardly extending parallel trough walls and a trough bottom portion, the trough bottom connecting the parallel trough walls.

26. The long travel lift apparatus of claim 24 wherein the outwardly extending member further extends across the inner diameter of the lower inner tube end and is attached to diametrically opposed portions of the inner tube for enhancing the strength of a plate-to-tube junction.

27. The long travel lift apparatus of claim 24 wherein the lengthwise slot is flanked by outwardly extending parallel guide plates, the parallel guide plates for protecting the tension member and for reinforcing the outer tube during lifting operations.

28. The long travel lift apparatus of claim 24 wherein the outer tube is outfitted with reinforcement means, the reinforcement means for reinforcing the outer tube during lifting operations.

29. The long travel lift apparatus of claim 25 wherein the load-receiving trough comprises a downwardly extending male structure, the downwardly extending male structure for coupling with a female structure formed in a compression member, the downwardly extending male structure thus for enhancing a user's ability to mate a compression member with the load-receiving trough for enhancing the load-bearing characteristics of the long travel lift apparatus.

30. The long travel lift system of claim 24 wherein the means for imparting a lift force comprise geared transmission means, the geared transmission means for enhancing the user's ability to impart lift force.

* * * * *